US011786038B2

(12) United States Patent
Lobo

(10) Patent No.: US 11,786,038 B2
(45) Date of Patent: Oct. 17, 2023

(54) ADJUSTABLE PILLOW FOR PAIN AND PRESSURE RELIEF

(71) Applicant: Aaron Ignatius Lobo, Green River, WY (US)

(72) Inventor: Aaron Ignatius Lobo, Green River, WY (US)

( * ) Notice: Subject to any disclaimer, the term of this patent is extended or adjusted under 35 U.S.C. 154(b) by 79 days.

(21) Appl. No.: 17/149,235

(22) Filed: Jan. 14, 2021

(65) Prior Publication Data

US 2021/0227980 A1 Jul. 29, 2021

Related U.S. Application Data

(60) Provisional application No. 63/090,420, filed on Oct. 12, 2020, provisional application No. 62/965,532, filed on Jan. 24, 2020.

(51) Int. Cl.

| | |
|---|---|
| ***A47C 7/18*** | (2006.01) |
| ***A47G 9/10*** | (2006.01) |
| ***A47C 7/02*** | (2006.01) |
| ***A47C 7/14*** | (2006.01) |
| ***A47G 9/02*** | (2006.01) |

(52) U.S. Cl.

CPC ..... *A47C 7/14* (2013.01); *A47C 7/021* (2013.01); *A47C 7/18* (2013.01); *A47G 9/0253* (2013.01); *A47G 9/109* (2013.01); *A47G 2009/1018* (2013.01)

(58) Field of Classification Search

CPC .. A47C 7/14; A47C 7/18; A47C 7/021; A47C 7/383; A47G 9/0253; A47G 2009/1018

See application file for complete search history.

(56) References Cited

U.S. PATENT DOCUMENTS

| | | | | |
|---|---|---|---|---|
| 4,617,691 | A * | 10/1986 | Monti | A47C 7/383 5/636 |
| 6,266,832 | B1 * | 7/2001 | Ezell | B60N 2/2881 5/636 |
| 6,499,165 | B1 * | 12/2002 | Morgillo | A47D 13/08 5/655 |
| 6,641,220 | B2 * | 11/2003 | Clegg | A47C 7/383 5/636 |
| 7,698,763 | B2 * | 4/2010 | Warnock | A61G 7/072 5/636 |
| 7,958,582 | B1 * | 6/2011 | Scamardo | B60N 2/885 5/632 |
| 11,051,635 | B2 * | 7/2021 | Johnson | A61F 5/05891 |
| 2002/0113482 | A1 * | 8/2002 | Clegg | A47C 7/383 297/391 |
| 2003/0041380 | A1 * | 3/2003 | Hanley | A47C 20/027 5/640 |
| 2003/0226207 | A1 * | 12/2003 | Lowenthal | A47C 7/383 5/636 |
| 2007/0256242 | A1 * | 11/2007 | Warnock | A61F 5/05891 5/636 |
| 2010/0242180 | A1 * | 9/2010 | Warnock | A61G 7/072 5/637 |

(Continued)

*Primary Examiner* — Eric J Kurilla

(74) *Attorney, Agent, or Firm* — Workman Nydegger

(57) ABSTRACT

A portable support, pain or pressure relief device comprising a plurality of pillows where a first pillow comprises an opening. A second pillow is disposed in the opening forming an aperture and is selectively adjustable in the opening to adjust a shape and size of the aperture.

19 Claims, 9 Drawing Sheets

(56) References Cited

U.S. PATENT DOCUMENTS

| | | | | |
|---|---|---|---|---|
| 2011/0277243 | A1* | 11/2011 | Crompton | A47C 20/026 5/632 |
| 2013/0138026 | A1* | 5/2013 | Tullous | A61F 5/05891 602/17 |
| 2014/0130261 | A1* | 5/2014 | Gumbrecht | A47C 7/383 5/644 |
| 2015/0245967 | A1* | 9/2015 | Horng | A61G 7/072 128/845 |
| 2019/0239668 | A1* | 8/2019 | Sabulao | A47G 9/1009 |
| 2019/0298082 | A1* | 10/2019 | Johnson | A61F 5/01 |
| 2020/0205591 | A1* | 7/2020 | Li | A61F 5/566 |
| 2020/0253397 | A1* | 8/2020 | Diaz | A47G 9/1081 |
| 2020/0288877 | A1* | 9/2020 | Duong | A47C 7/425 |
| 2020/0288893 | A1* | 9/2020 | Emdadi | A47G 9/1081 |
| 2021/0127867 | A1* | 5/2021 | Lee | A47C 7/383 |
| 2021/0227980 | A1* | 7/2021 | Lobo | A47G 9/109 |
| 2022/0117397 | A1* | 4/2022 | Scaparotti | A47G 9/1081 |

* cited by examiner

ADJUSTABLE PILLOW FOR PAIN AND PRESSURE RELIEF

CROSS-REFERENCE TO RELATED APPLICATIONS

This application claims the benefit of and priority to U.S. Provisional Patent Application Ser. No. 62/965,532 filed on Jan. 24, 2020 and entitled "A configurable device or pillow to provide support and or pressure relief to individuals of different shape and sizes," and also claims the benefit of and priority to Provisional Patent Application Ser. No. 63/090,420 filed on Oct. 12, 2020 and entitled "A configurable device or pillow to provide support and or pressure relief to individuals of different shape and sizes," both of which are expressly incorporated herein by reference in their entirety.

BACKGROUND

Background and Relevant Art

Humans and other creatures come in various shapes and sizes and they rest by sitting down, laying down, leaning against static structures, or in other ways. A pillow or a cushion offers support and comfort to various parts of a person's body while at rest. Sitting or sleeping for extended periods of time due to pregnancy, desk job, injuries, medical conditions, or other reasons, can be uncomfortable or painful due to the one's own pressure or weight, even when a pillow is used. What is needed is a portable device that can be adjusted to various shapes and sizes for various body parts and their various shapes, sizes, orientations, and the like, while providing support to provide relief from pain and pressure to alleviate discomfort or pain while resting, working, or in other scenarios.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

One embodiment illustrated herein includes a portable support, pain or pressure relief device comprising a plurality of pillows where a first pillow comprises an opening. A second pillow is disposed in the opening forming an aperture and is selectively adjustable in the opening to adjust a shape and size of the aperture.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings, which are not necessarily drawn to scale, in which.

DETAILED DESCRIPTION

Figure 1:
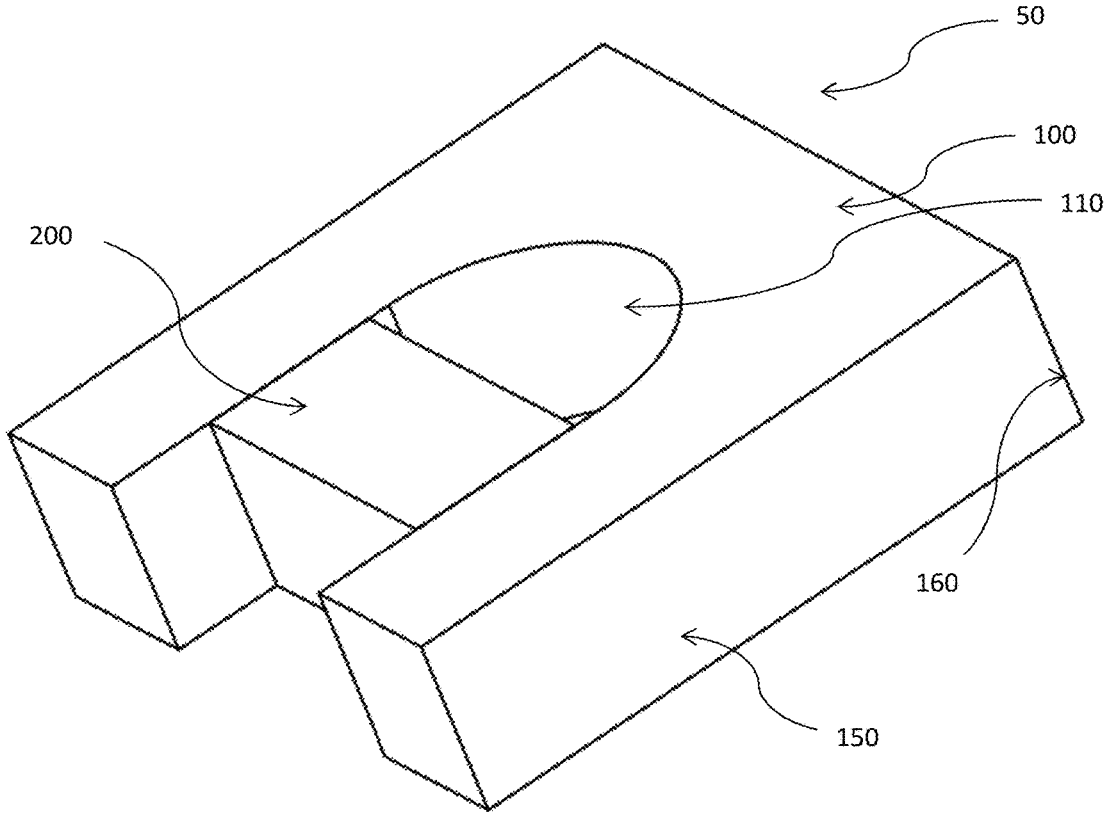
FIG. 1: Perspective view illustrating a device.

The present invention is directed to devices and methods to provide support, pain relief or pressure relief to various parts of an individual's body. This can be accomplished as the individual lies down, sits down, leans against static structures, or in other situations. Thus, embodiments may apply to resting positions, work postures, or other conditions.

One embodiment includes a device having a first pillow having a body with an opening formed therein and an accompanying second pillow that is configurable in the opening to adjust the shape and size of an aperture formed by the first pillow and second pillow to provide the much-needed support to the individual using it. In some embodiments, the opening and/or aperture is symmetrical with respect to at least one axis of the body. This can be particularly useful when configuring the device for symmetrical positioning of body parts on the device. Indeed, this is particularly applicable when the aperture is formed symmetrical to an axis running through the centroid of the device. Alternatively, the opening and/or aperture is asymmetrical in some or all axis of the device. This may be particularly useful when the device is used in a position where the device center is between two differently shaped body parts.

In one example, while seated upon the device, the first pillow supports the gluteus maximus muscles while the second pillow is adjusted to provide support at the gluteal sulcus such that it would support the weight of the individual and put the hips in the neutral position and alleviate discomfort. Some embodiments of this example are manufactured using pillow filling material or urethane foam. Different embodiments may use different densities and different indentation load deflection (ILD) of foam depending on the intended use. For example, urethane foam like High resilience (HR) foam, Lux foam etc.

Some embodiments are substantially triangular in shape, while other embodiments are substantially square in shape, while other embodiments are substantially circular in shape, while other embodiments are substantially polygonal in shape, etc. Shapes can be selected depending on desired use cases, for aesthetic purposes, or for other reasons.

The cross section of the pillows can be square, rectangular, hollow, a polygon, hybrid of a circle and a polygon, semicircular and/or circular.

The pillows may be attached by various attachment means, such as by using one or more of adhesives, mechanical fasteners, friction, hook and loop fasteners, and/or combinations thereof.

Various different embodiments can be constructed of various materials including one or more of urethane foam, natural fibers, synthetic fibers, pillow filling material, material at least partially encased within a cover, and/or combinations thereof. Note that the different pillows can be constructed of the same or different materials. Further, the pillows can be of same cross section or of different cross sections. This can be done for aesthetic purposes or to achieve particular functionality.

In some embodiments, the body may be constructed with a slant from one end to the other (e.g., front to back, or back to front) forming a wedge shape to achieve certain body positioning. In other embodiments, the body may be constructed where the top and bottom surfaces are parallel to each other such that no wedge shape is implemented. This may be performed to achieve a more universal design suitable for multiple different use scenarios.

Some embodiments may be specifically configured for ease of manufacture, to be comfortable, durable and/or easily cleaned. For example, in some embodiments, the pillows have a cover made of one or more fabrics that are washable to increase the versatility of the pillow so that it can be used in a wide variety of settings.

Referring now to FIG. 1, additional details are illustrated. A device 50 includes a first pillow 100 with an aperture 110 and an accompanying second pillow 200 that is used to adjust the shape and size of the aperture 110. The second pillow 200 can be moved along the length of the opening 105 (see FIG. 2) to adjust the shape and size of the aperture 110 formed by the first pillow 100 and the second pillow 200.

Figure 18:
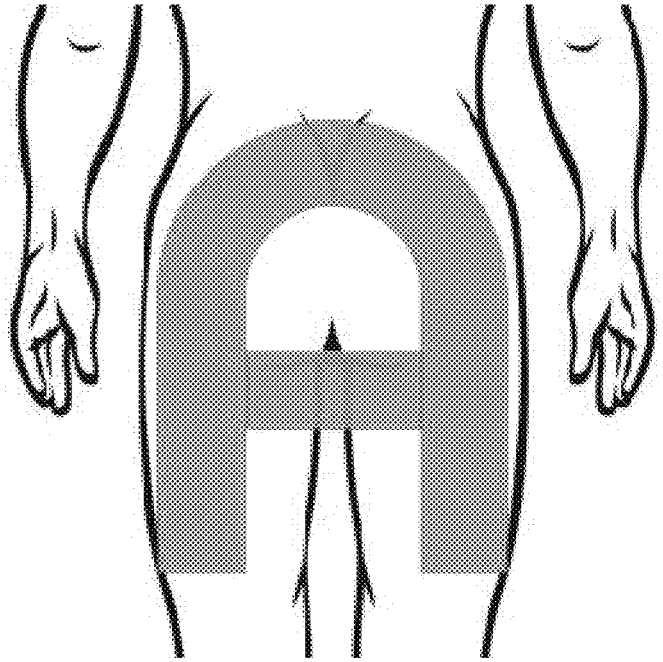
FIG. 18: Use case for one embodiment for coccyx region and/or ischial support.

In one example, the second pillow 200 is moved along the opening 105 of the first pillow 100 so that it lines up with the gluteal sulcus of a particular individual using the device such that they can experience maximum comfort in the coccyx and ischial portions while being seated on the particular embodiment. An example of this is illustrated in FIG. 18.

The second pillow 200 is connected to the first pillow 100 through any one of a number of different means. For example, in some embodiments, the second pillow 200 may be coupled to the first pillow using adhesives. Alternatively, the second pillow may be connected to the first pillow using mechanical fasteners. For example, such mechanical fasteners may include one or more of hook and loop fasteners, snaps, buttons, pins, or other appropriate fasteners. In some embodiments, the second pillow 200 may be coupled to the first pillow using friction. Combinations of the preceding may additionally or alternatively be used to couple the second pillow 200 to the first pillow 100.

In some embodiments, the aperture 110 is symmetrical with respect to one or more axis running through a centroid of the device. Such configurations may be useful when attempting to provide equal support to symmetrical body parts. For example, when the device is configured to support, at a center of the device, one or more body parts intersected by the sagittal plane of the body, it may be advantageous to have the device 50 configured such that the aperture 110 is symmetrical about an axis running through the centroid of the device 50 to provide equal support to the body parts.

In contrast, in some embodiments, the aperture 110 is asymmetrical with respect to one or more axis running through a centroid of the device 50. For example, if the device 50 is configured to support body parts intersected by the coronal plane, the transverse plane, or planes parallel thereto, embodiments may be better suited for such support if the aperture 100 is asymmetrical about an axis running through the centroid of the device 50.

Figure 19:
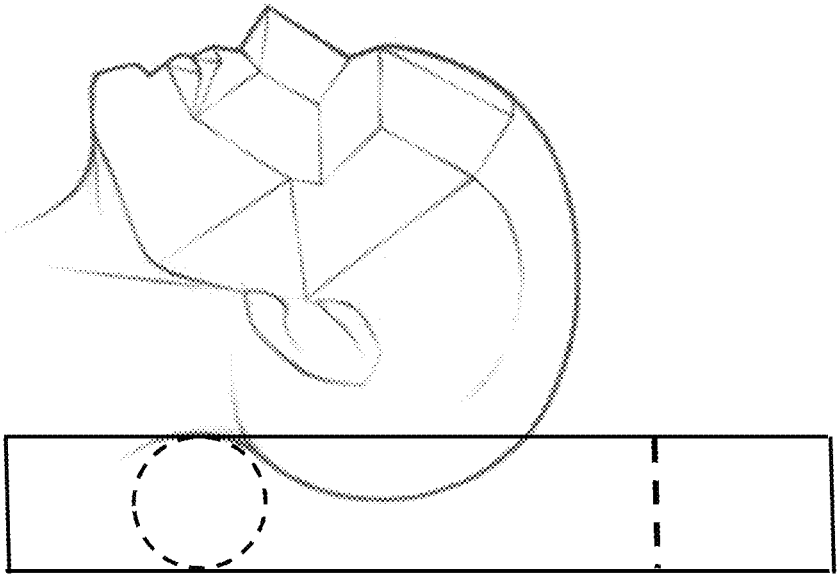
FIG. 19: Use case for one embodiment for cervical support.

In some embodiments, the aperture may be symmetrical about one axis running through the centroid of the device 50, while asymmetrical about another axis running through the centroid of the device. For example, in one embodiment, while laying down, the second pillow 200 can be adjusted to provide support to the neck while the head is held in place in the aperture 110. FIG. 1 illustrates such an example of one such configuration. One can observe that the device 50 is symmetrical about one axis while asymmetrical about a perpendicular axis. Attention is also directed to FIG. 19, which illustrates an example where this embodiment might be implemented.

Figure 20:
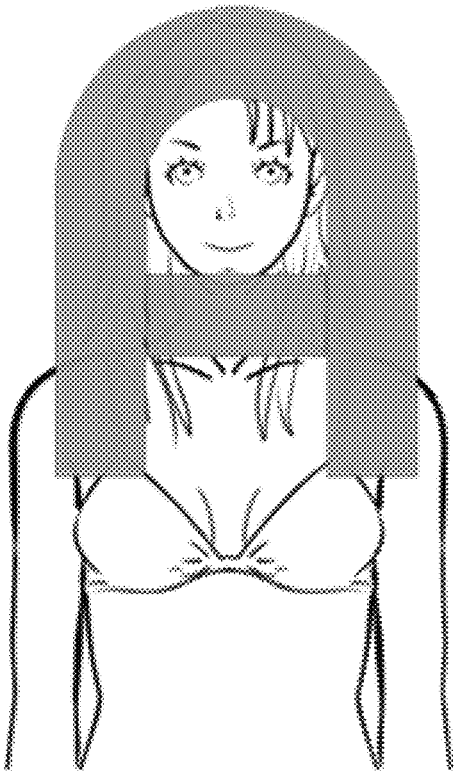
FIG. 20: Use case for one embodiment for facial support.

In some embodiments, for migraines, while laying down face first, the second pillow 200 can be adjusted to support the chin and the first pillow 100 to support the forehead. An example of this is illustrated in FIG. 20.

Figure 21:
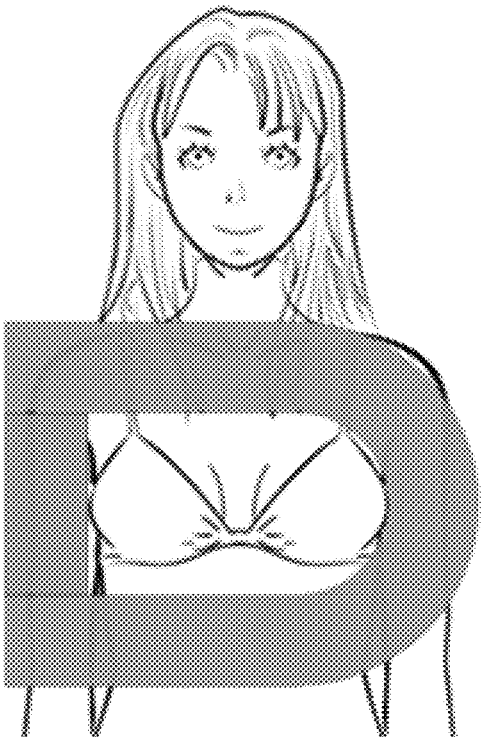
FIG. 21: Use case for one embodiment for breast and/or thorax.

The first pillow 100 on its own or along with the second pillow 200 can be also used to support large breasts or thorax as illustrated in FIG. 21.

Figure 2:
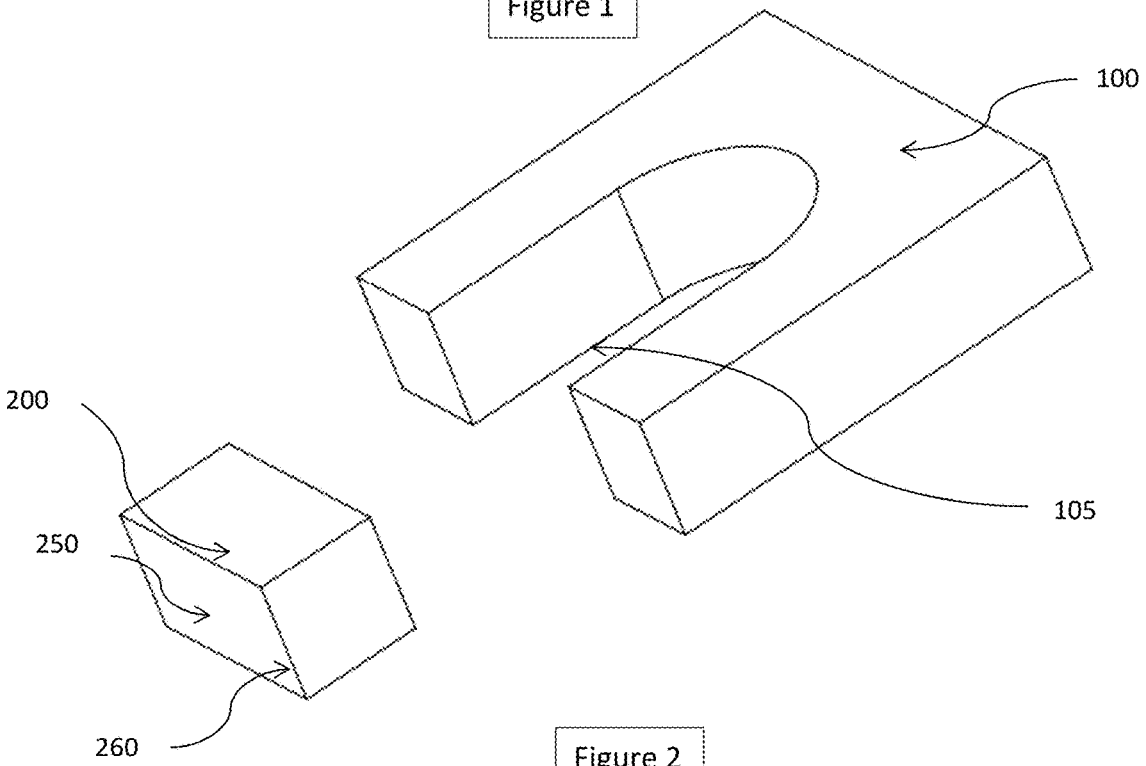
FIG. 2: exploded view illustrating the device of FIG. 1
Figure 3:
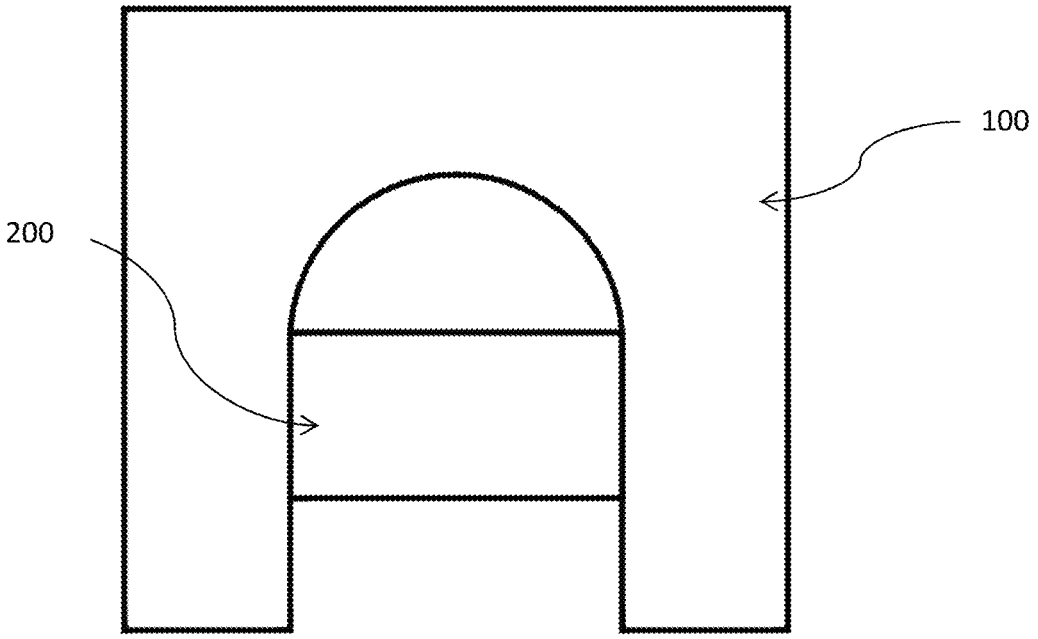
FIG. 3: Top View illustrating the device of FIG. 1

FIG. 2 and FIG. 3 displays an exploded view of the device 50 and a top view of the device 50 respectively.

The cross section of the pillows 100 and 200 can be square, rectangular, hollow, polygon, hybrid of circle and a polygon, semicircular circular, or combinations thereof. As noted previously they may be attached to one another using adhesives, mechanical fasteners, friction, or combinations thereof.

Figure 4:
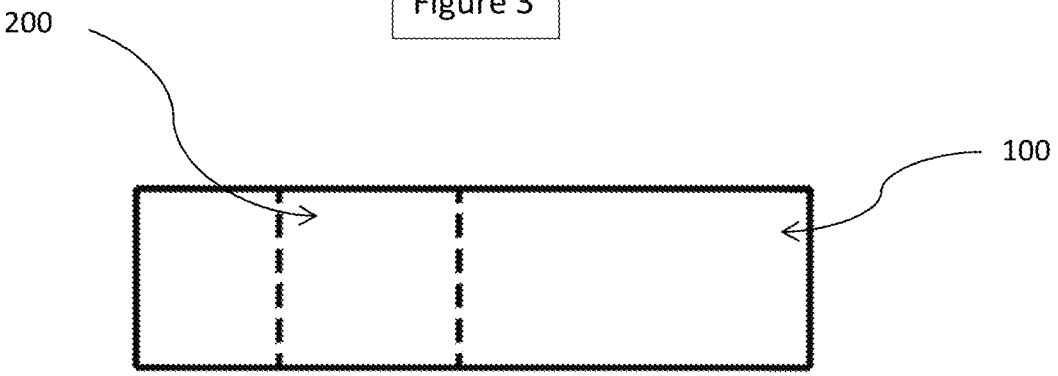
FIG. 4: Right Side view illustrating the device of FIG. 1
Figure 5:
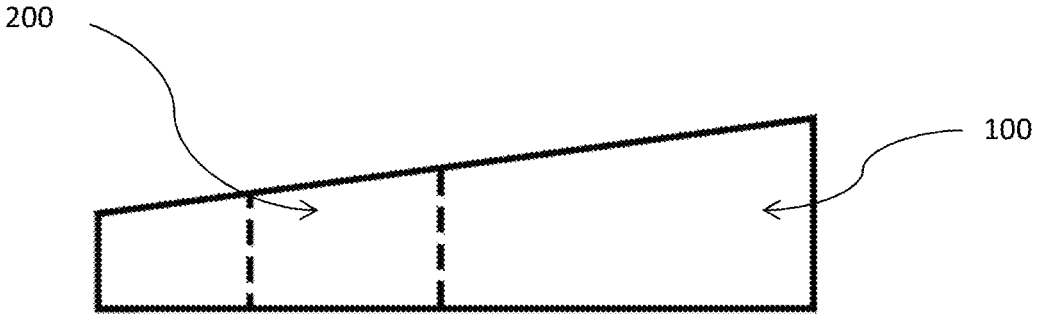
FIG. 5: Right Side view illustrating a taper in the device of FIG. 1
Figure 6:
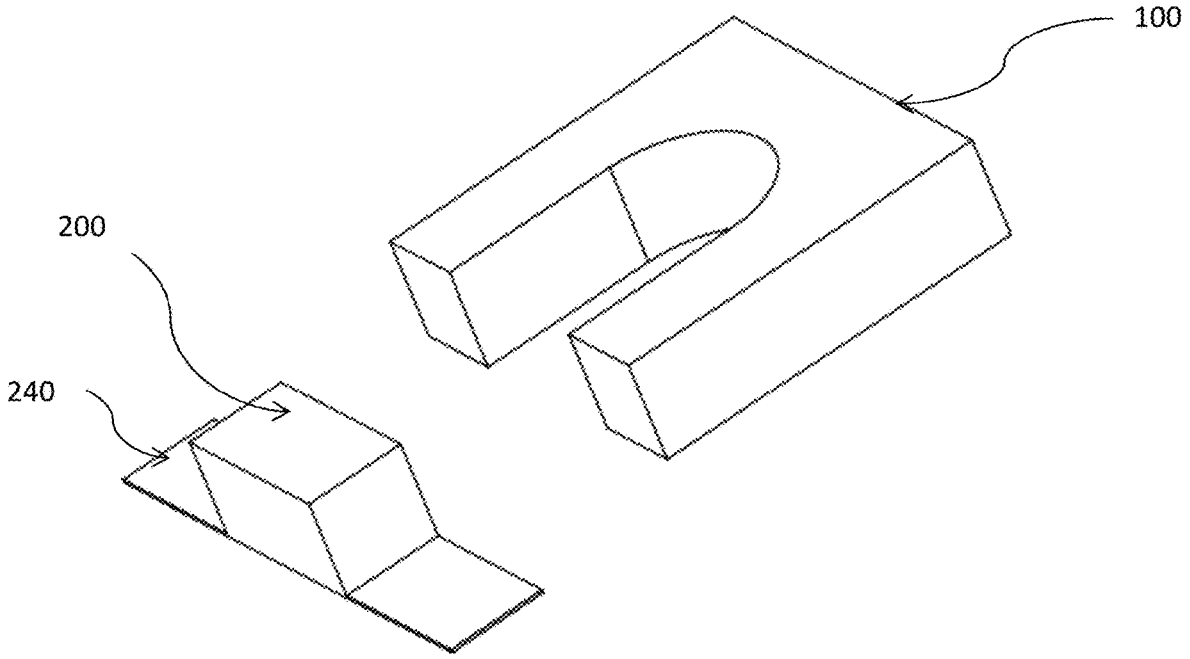
FIG. 6: Perspective view illustrating a device, according to a second embodiment of the invention.
Figure 7:
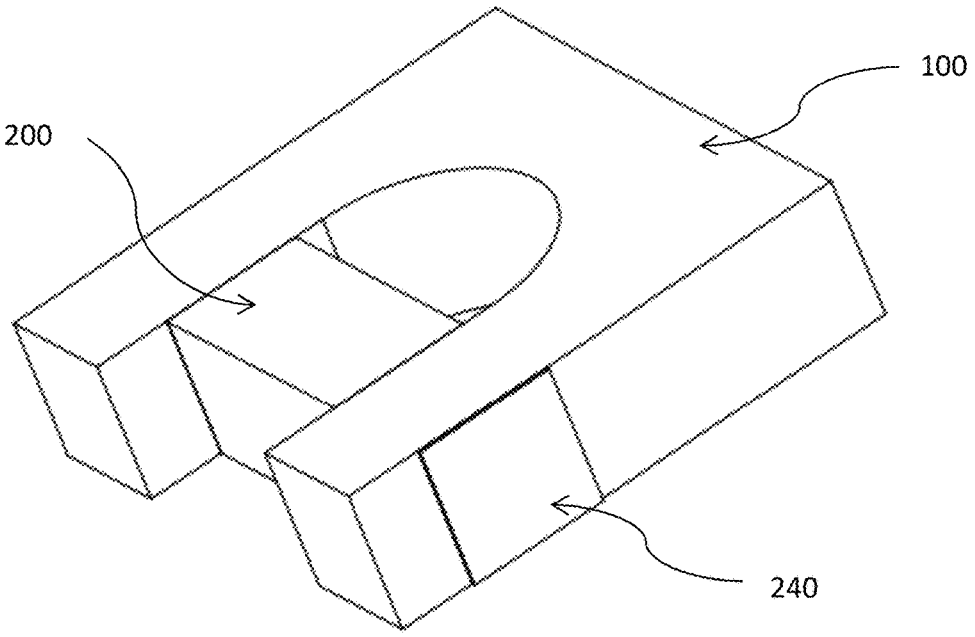
FIG. 7: Perspective view of the assembled device in FIG. 6
Figure 8:
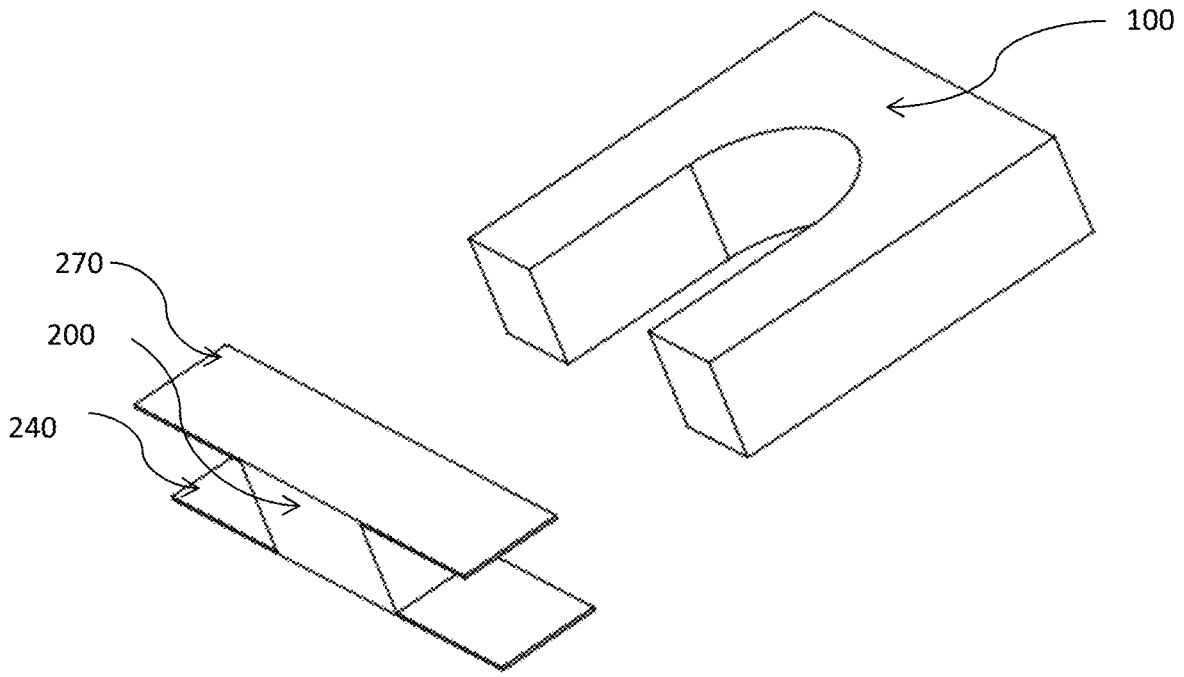
FIG. 8: Perspective view illustrating a device, according to a third embodiment of the invention.
Figure 9:
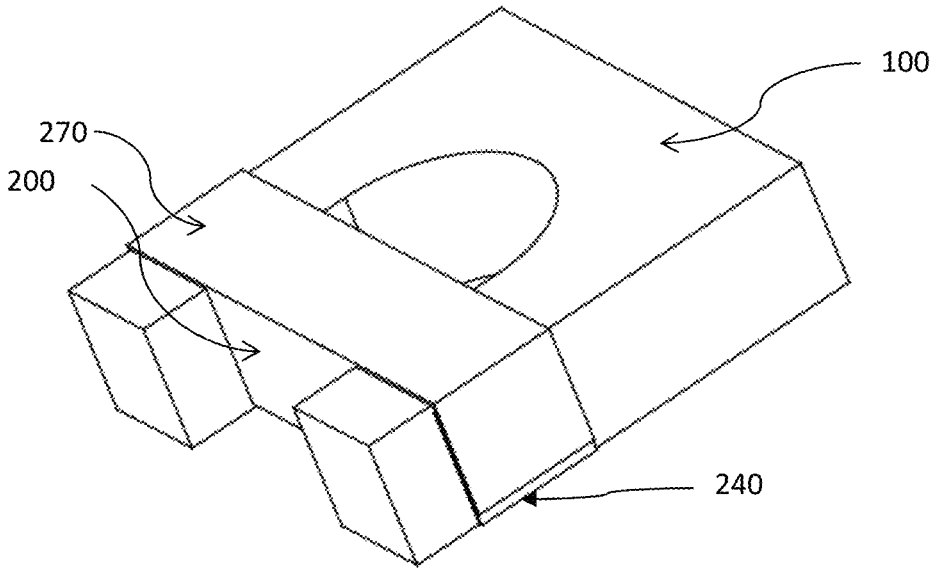
FIG. 9: Perspective view of the assembled device in FIG. 8

In FIG. 4 an embodiment is illustrated where the thickness of the illustrated embodiment is substantially consistent throughout the length and width of the body. In an alternative embodiment illustrated in FIG. 5, the thickness varies along the length of the body to form a tapered wedge. One or more sides 150 of the first pillow 100 may be curvilinear, while in other embodiments, the sides 150 of the first pillow 100 may be linear. The edges 160 of the first pillow 100 may be curvilinear, while in other embodiments, the edges 160 of the first pillow 100 may be linear.

One or more sides 250 of the second pillow 200 may be curvilinear, while in other embodiments one or more sides 250 of the second pillow may be linear. One of more edges 260 of the second pillow 200 may be curvilinear while in other embodiments, the edges 260 of the second pillow 200 may be linear.

Referring now to FIGS. 6 through 9, the second pillow 200 may be equipped with one attachment device 240 comprising flaps or wings on one side and/or a second attachment device 270 comprising flaps or wings on the other side configured to provide a more secure attachment of the second pillow 200 to the first pillow 100 than in embodiments without the attachment devices 240 and/or 270. The attachment devices 270 and 240 may utilize hook and loop fasteners, buttons, snaps, adhesives, or other fasteners to for attaching the second pillow 200 and first pillow 100.

The opening 50 of the first pillow 100 could be substantially elliptical (or oval) shape, a substantially rectangular shape, a substantially triangular shape, a substantially circular shape, a substantially square shape, a substantially polygonal shape, etc. The second pillow 200 and first pillow 100 can be one piece or comprised of multiple pieces.

Figure 10:
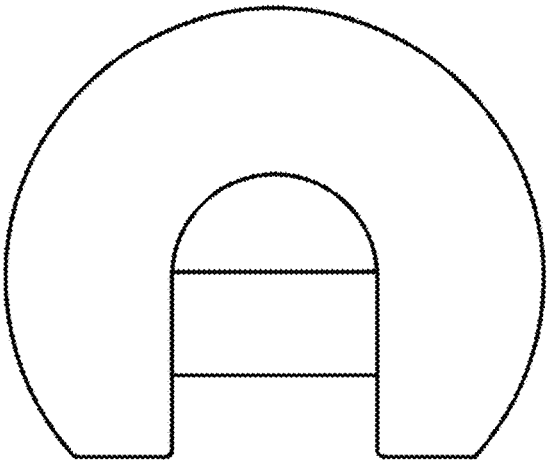
FIG. 10: Top view illustrating a device, according to a fourth embodiment of the invention.
Figure 11:
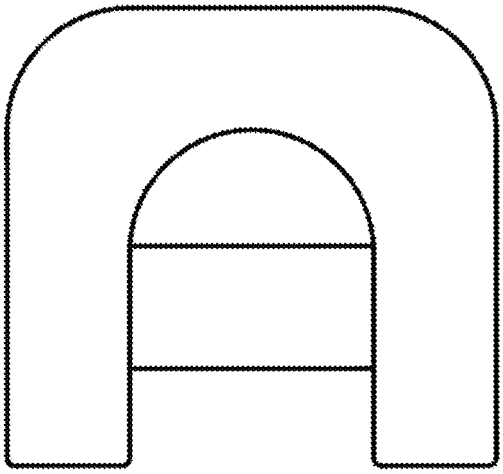
FIG. 11: Top view illustrating a device, according to a fifth embodiment of the invention.
Figure 12:
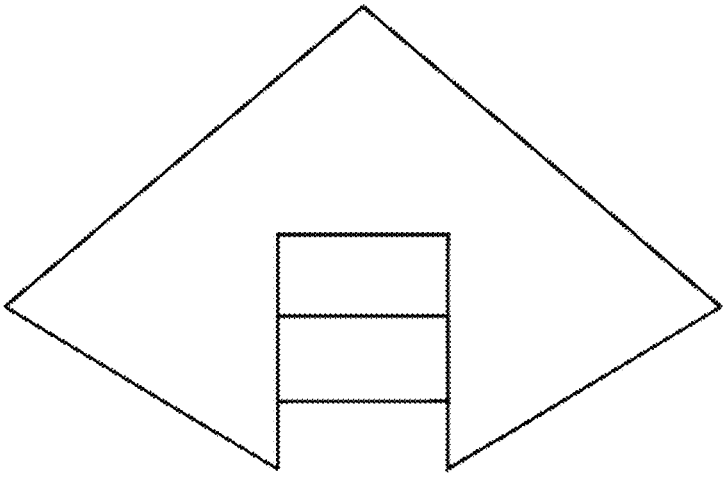
FIG. 12: Top view illustrating a device, according to a sixth embodiment of the invention.
Figure 13:
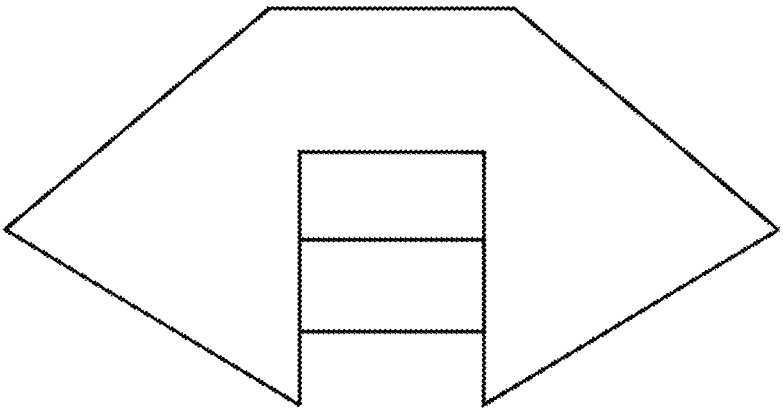
FIG. 13: Top view illustrating a device, according to a seventh embodiment of the invention.
Figure 14:
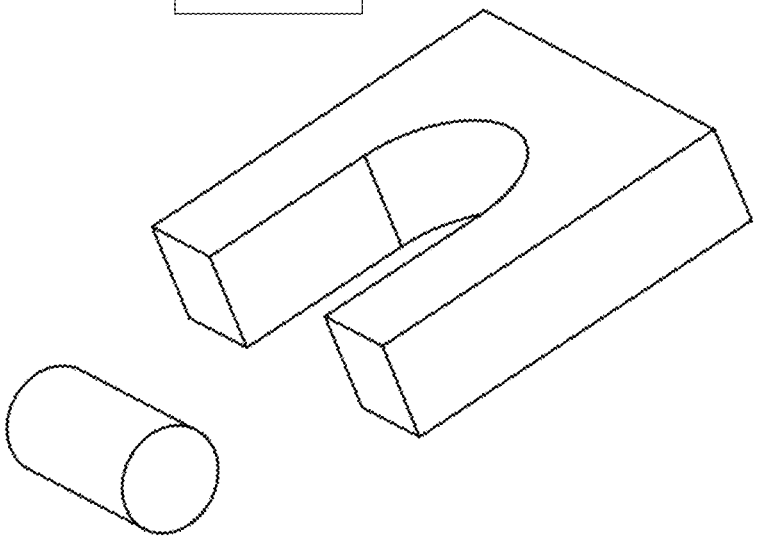
FIG. 14: Perspective view illustrating a device, according to an eighth embodiment of the invention.
Figure 15:
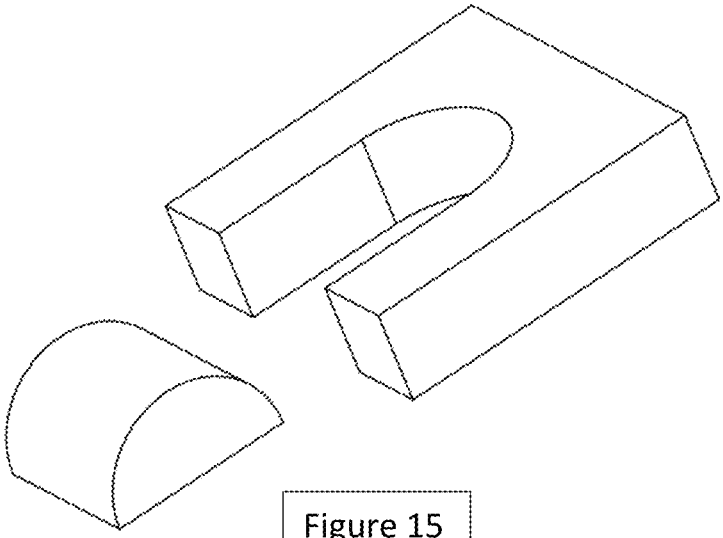
FIG. 15: Perspective view illustrating a device, according to a ninth embodiment of the invention.
Figure 16:
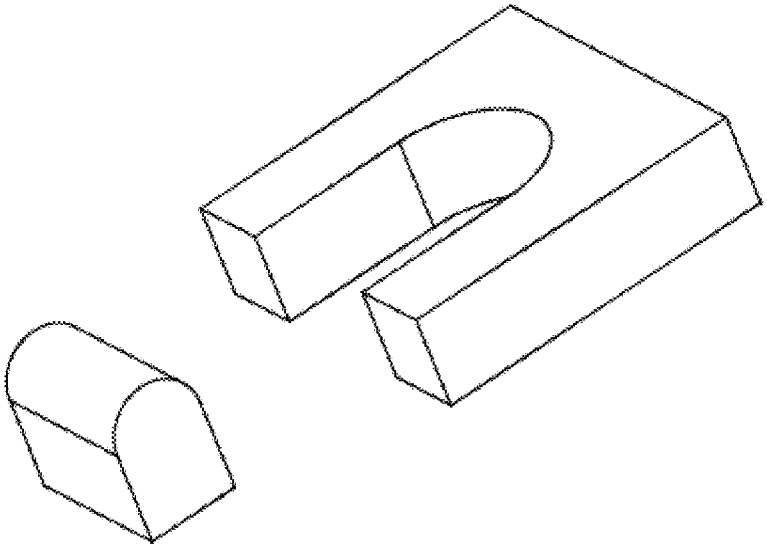
FIG. 16: Perspective view illustrating a device, according to a tenth embodiment of the invention.
Figure 17:
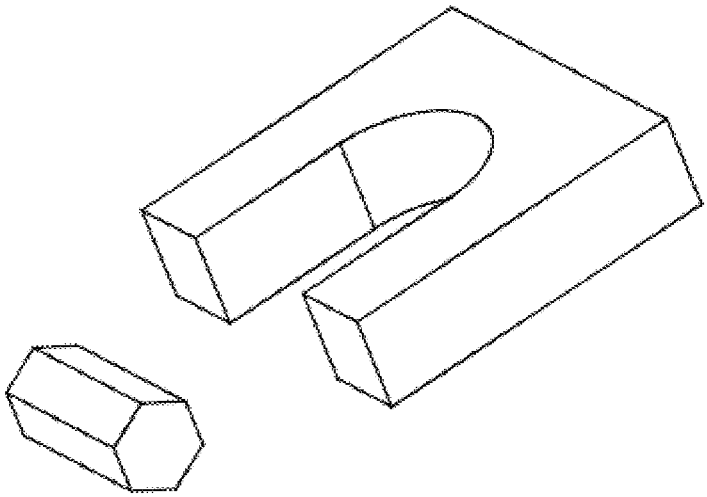
FIG. 17: Perspective view illustrating a device, according to an eleventh embodiment of the invention.

FIG. 10-FIG. 13 illustrate various alternative embodiments with regards to the shape first pillow 100 and FIG. 14-FIG. 17 are various embodiments with regards to the shape of the second pillow 200. The features described with respect to the embodiment in FIG. 1-5 are also applicable to these embodiments. In FIG. 10 the outside of the first pillow 100 is curved to fit chairs that have a circular seat like those in bar stools. In FIG. 11 the edge is rounded so as to fit snug with round corner office chairs. In FIG. 12 the aperture 110 is cut at the edge of the rectangle to accommodate gaming chairs. In FIG. 13 the first pillow 100 is in a shape of a polygon. Some embodiments of the invention are not limited to any particular degree of curvature or linearity for any of the sides. Some embodiments of the invention are not limited to any particular dimensions. Some embodiments of the invention are not limited to any thickness of the first pillow 100, which in some embodiments is the same as that of the second pillow 200, while in other embodiments, the first and second pillow are of different thicknesses. The location of the aperture 110 is not limited to any particular position of the body. The cross section of the second pillow 200 may or may not be the same as that of the first pillow 100.

Some embodiments are manufactured using pillow filling material or urethane foam. Any appropriate density of the foam may be used, as appropriate for a given configuration. Additionally, the referred device could be substantially triangular in shape, substantially square in shape, substantially circular in shape or substantially polygonal in shape, etc.

In other embodiments, pillow-filling material may include wool, feather, cotton, polyester, fiber, other synthetic material, fluid, or the like, or any combination thereof. As used herein, a fluid refers to a substance that has no fixed shape and yields easily to external pressure.

The body of the embodiment could be solid or hollow, and the hollow body may be filled partially with pillow filling material or with an electronic device. The embodiment is encased with a fitted or unfitted cover. The cover may be made from variety of materials, including synthetic or natural fabrics and natural/synthetic blends like rayon, polyester.

In one embodiment, the thickness of the device is about three inches. This thickness has been shown to be a suitable compromise for comfort, durability and cushioning while ensuring that it can support an average individual's weight without bottoming out.

While there are shown and described herein a specific form of the invention, it will be readily apparent to individuals skilled in the art that the invention is not so limited, but is susceptible to, various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

The present invention may be embodied in other specific forms without departing from its characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A device for providing at least one of support, pain relief, or pressure relief, the device comprising:

a body, wherein the body comprises a first pillow, wherein the first pillow comprises an opening; and the body further comprising a second pillow placed in the opening, the first and second pillow forming an aperture, wherein the second pillow is selectively adjustable in the opening to configurably adjust a shape and size of the aperture, wherein the second pillow comprises selectively attachable flaps or wings which overlap at least a portion of the first pillow for attaching the second pillow to the first pillow securing the second pillow within the opening to help prevent, while the flaps or wings are attached to the first pillow, further adjustment of the second pillow in the opening, helping to prevent further adjustment of the shape and size of the aperture.

2. The device of claim 1, wherein the device is constructed of at least one of cotton, polyester, silk, rayon, or olefin.

3. The device of claim 1, wherein the first and second pillows have a cross-section that is at least one of square, rectangular, hollow, polygonal, hybrid of a circle and polygon, semicircular, or circular.

4. The device of claim 1, wherein the device is constructed of at least one of high density foam, natural fibers, synthetic fibers, or pillow filling material at least partially encased within a cover.

5. The device of claim 1, wherein the first and second pillows are constructed of different materials.

6. The device of claim 1, wherein the first and second pillows have different cross sections.

7. The device of claim 1, wherein the body of the first pillow forms a wedge shape.

8. The device of claim 1, wherein the device comprises a cover made of fabric that is washable.

9. The device of claim 1, wherein the flaps or wings comprise hook and loop fasteners for selectively attaching the second pillow to the first pillow.

10. A method of manufacturing a device for providing at least one of support, pain relief, or pressure relief, the method comprising:

forming a device body by:

providing a first pillow, wherein the first pillow comprises an opening; and placing a second pillow in the opening, the first and second pillow forming an aperture, wherein the second pillow is selectively adjustable in the opening to configurably adjust a shape and size of the aperture, wherein placing a second pillow in the opening comprises attaching selectively attachable flaps or wings on the second pillow in an overlapping fashion on at least a portion of the first pillow for attaching the second pillow to the first pillow, securing the second pillow within the opening helping to prevent destruction of the aperture while the flaps or wings are attached to the first pillow.

11. The method of claim 10, further comprising constructing the first and second pillows to have a cross-section that is at least one of square, rectangular, hollow, polygonal, hybrid of a circle and polygon, semicircular, or circular.

12. The method of claim 10, further comprising constructing the device of at least one of high density foam, natural fibers, synthetic fibers, or pillow filling material at least partially encased within a cover.

13. The method of claim 10, further comprising constructing the first and second pillows from different materials.

14. The method of claim 10, further comprising constructing the first and second pillows with different cross sections.

15. The method of claim 10, further comprising forming the body of the first pillow into a wedge shape.

16. A kit for implementing a device for providing at least one of support, pain relief, or pressure relief, the kit comprising:

a first pillow, wherein the first pillow comprises an opening;

one or more additional pillows configured to be placed in the opening, such that when one of the additional pillows is placed in the opening, the first pillow and the one of the additional pillows form an aperture, wherein the one of the additional pillows is selectively adjustable in the opening to configurably adjust a shape and size of the aperture, and wherein the one of the additional pillows comprises selectively attachable flaps or wings which are configured to overlap at least a portion of the first pillow for more securely attaching the second pillow to the first pillow than when the flaps or wings are not selectively attached, helping prevent movement of the second pillow within the opening when the flaps or wings are selectively attached.

17. The kit of claim 16, the one or more additional pillows comprising a plurality of different pillows having different shapes.

18. The kit of claim 16, wherein the first pillow and one or more of the one or more additional pillows have a cross-section that is at least one of square, rectangular, hollow, polygonal, hybrid of a circle and polygon, semicircular, or circular.

19. The kit of claim 16, wherein the first pillow and one or more of the one or more additional pillows have different cross sections.

* * * * *